United States Patent [19]

Moser et al.

[11] Patent Number: 4,517,554

[45] Date of Patent: May 14, 1985

[54] METHOD AND APPARATUS FOR INSPECTING A DANGER ALARM SYSTEM

[75] Inventors: Otto W. Moser; Peer Thilo, both of Munich, Fed. Rep. of Germany

[73] Assignee: Siemens Aktiengesellschaft, Berlin & Munich, Fed. Rep. of Germany

[21] Appl. No.: 374,756

[22] Filed: May 4, 1982

[30] Foreign Application Priority Data

May 26, 1981 [DE] Fed. Rep. of Germany ..... 3120986

[51] Int. Cl.[3] ..... G08B 23/00

[52] U.S. Cl. ..... 340/514; 340/505; 340/506; 340/511; 340/518; 340/525

[58] Field of Search ..... 340/514, 505, 506, 500, 340/501, 518, 524, 525, 527, 531, 536, 537, 660–664, 825.06–825.13, 825.15, 825.29, 825.54, 511

[56] References Cited

U.S. PATENT DOCUMENTS

| | | | |
|---|---|---|---|
| 3,665,399 | 5/1972 | Zehr et al. | 340/518 |
| 3,806,872 | 4/1974 | Odom | 340/518 |
| 4,001,785 | 1/1977 | Miyazaki et al. | 340/518 |
| 4,067,008 | 1/1978 | Sprowls | 340/518 |
| 4,254,411 | 3/1981 | Moser et al. | 340/505 |
| 4,400,694 | 8/1983 | Wong et al. | 340/514 |

*Primary Examiner*—Donnie L. Crosland
*Attorney, Agent, or Firm*—Hill, Van Santen, Steadman & Simpson

[57] ABSTRACT

A method and apparatus for inspecting a danger alarm system, such as a fire alarm system, having a plurality of discrete alarm units which are connected to a central station having a means for cyclically sampling and connecting the alarm units to a like plurality of evaluators permits the alarm units to be connected individually or in groups to an inspection display without suppressing the display of an actual alarm signal which may be received during the inspection. A first report of an alarm unit to be inspected is evaluated as an inspection report and an actual alarm report from the same alarm unit arriving after the inspection report is evaluated and displayed as an alarm report. Given alarm units which emit multi-level or analog signals, the alarm unit signals are evaluated in the central station with two threshold circuits, the evaluator at the central station being switched during an inspection to a less sensitive state and the inspection signals being evaluated by a lower threshold stage and a true alarm signal which may occur during an inspection being evaluated as such by an upper threshold stage.

15 Claims, 9 Drawing Figures

METHOD AND APPARATUS FOR INSPECTING A DANGER ALARM SYSTEM

BACKGROUND OF THE INVENTION

1. Field of the Invention

The present invention relates to a method and apparatus for inspecting a danger alarm system such as a fire alarm system, and in particular to a method and apparatus for inspecting such a system which includes a plurality of alarms connected to a central station, the central station having a means for cyclically sampling and connecting the individual alarms to respective evaluators.

2. Description of the Prior Art

In order to guarantee reliable operation of danger alarm systems, such as fire alarm systems, all system components must be checked at regular intervals. This is generally undertaken by first testing the components in the individual alarms to be sure those components are operational, followed by triggering the alarms in order to check the transmission path to the central station. During the inspection, the alarm signals which are received from the triggered alarms are treated not as an indication of an actual or real alarm, but rather as an inspection signal or report. The inspected alarms are generally then automatically reset to an armed condition.

In conventional fire alarm systems, a plurality of discrete alarm units are connected in parallel or in series to an alarm line or bus. When an alarm unit connected to the alarm line is triggered, a current change of the alarm line occurs which is evaluated at the central station as an alarm report. Generally the particular alarm unit producing the alarm report cannot be identified at the central station and therefore, during an alarm unit inspection, the entire alarm line must always be switched to an inspection condition, that is, a changed current condition. All reports which are received on this alarm line are, during an inspection, evaluated as inspection reports rather than as actual alarm reports. Thus, depending upon the number of individual alarm units connected to a particular alarm line which is in an inspection condition, an area of significant proportions is momentarily unavailable for monitoring a true danger, such as a fire, and relaying a true alarm report to the central station, thus causing a considerable safety risk for the duration of the inspection.

In some conventional alarm systems, this safety risk is reduced by the use of a backup system of manually triggerable alarm units which are installed in addition to the automatic alarm units, the manual alarm units not being connected to the same alarm line as the automatic alarm units. This permits a manually actuatable alarm unit to be triggered upon the occurrence of an actual danger during the testing of the automatic alarm units.

The use of such a backup system presents the further problem, however, of testing the backup system, which cannot be undertaken simultaneously with a testing of the automatic system. A testing of the automatic and manual alarm units for a given area is generally undertaken by first switching the automatic alarm units to an inspection condition and checking those alarm units after which the tested automatic alarm line is returned to a hot or rearmed condition and the manually actuatable alarm units, which have their own alarm line, are switched to an inspection condition. The manual alarm units are then triggered and, after inspection, the manual alarm unit line is again switched to a hot or rearmed condition. The maintenance technician must thus cover the same area twice in order to trigger the different alarm units resulting in an increased time and cost outlay.

A further disadvantage of the use of a manual backup system connected as described above is that the changeover from the automatic alarm line to the manual alarm line for the alarm units in the same area must be undertaken at the central station, resulting in a further time delay which is particularly significant because the location of the individual alarm units is generally a rather large distance from the central station.

SUMMARY OF THE INVENTION

It is an object of the present invention to provide a method and apparatus for inspecting a danger alarm system which permits inspection of the alarm system without the danger of suppressing a true alarm report which may occur during the inspection.

It is a further object of the present invention to permit such an inspection to be undertaken in older alarm systems, in which the location of the individual alarm units connected to an alarm line cannot be identified, as well as in newer danger alarm systems which permit identification of the location of the individual alarm units, with equal reliability.

The above objects are inventively achieved in an alarm system in which the individual alarm units are connected to an inspection display at a central station such that a first report received from a particular alarm unit to be inspected is evaluated and displayed as an inspection report followed by resetting of the inspected alarm unit automatically after a preselected period of time, the inspection report being stored, and any further report from the same alarm unit being subsequently evaluated as an alarm report indicating a true alarm condition.

Utilizing the method and apparatus disclosed and claimed herein, individual alarm units, groups of alarm units, alarm lines or the entire alarm system can be switched to an inspection condition without the possibility of failing to report a true alarm condition.

Preferably an alarm unit will be reset several times and permitted to respond anew before a true alarm is perceived and forwarded. Only after a repeated response of an alarm unit which has already been inspected will an alarm signal be generated and displayed. Thus true alarms cannot be lost as a result of the multiple resetting, because the individual automatic alarm units always continue to respond as long as the alarm condition exists. Manually triggered alarm units store the report mechanically until reset by hand.

A significant advantage of such an inspection method and apparatus is that the system components need not be made inoperative during the inspection, rather a true alarm is perceived and displayed after a slight delay. Thus no reduction of safety occurs during the inspection.

A further advantage of the inspection method and apparatus disclosed herein is that automatic and manual alarm units can be connected to the same alarm line thus saving installation costs and permitting larger portions of the total system to be switched to an inspection condition than can be achieved with conventional systems. Moreover, different types of alarm units can be triggered in a random sequence, in those installations in which the location of the individual alarm units can be identified at the central station, thus significantly simplifying maintenance.

In existing alarm systems having alarm units which emit multi-level or analog signals which are evaluated at the central station, it is preferable to switch the evaluating means to a "less sensitive" state and to separately evaluate and display the signals from those alarm units by means of two threshold circuits at the central station. This means that the threshold stage for a true alarm signal is higher than the threshold stage for report signals which are to be utilized as inspection signals. The evaluation means at the central station has two threshold circuits respectively corresponding to upper and lower threshold values, whereby the alarm unit to be inspected emits an inspection signal which is evaluated and displayed as such by means of the lower threshold circuit. If danger conditions exist, which triggers a true alarm signal, the true alarm signal is perceived by the upper threshold stage of the evaluator circuit at the central station as such and is accordingly displayed as a true alarm.

FIGS. *3a, 3b, 3c* and *3d* are voltage-time diagrams showing the manner of operation of an alarm system constructed in accordance with the principles of the present invention under normal operating conditions and during inspection conditions.

Figure 4:
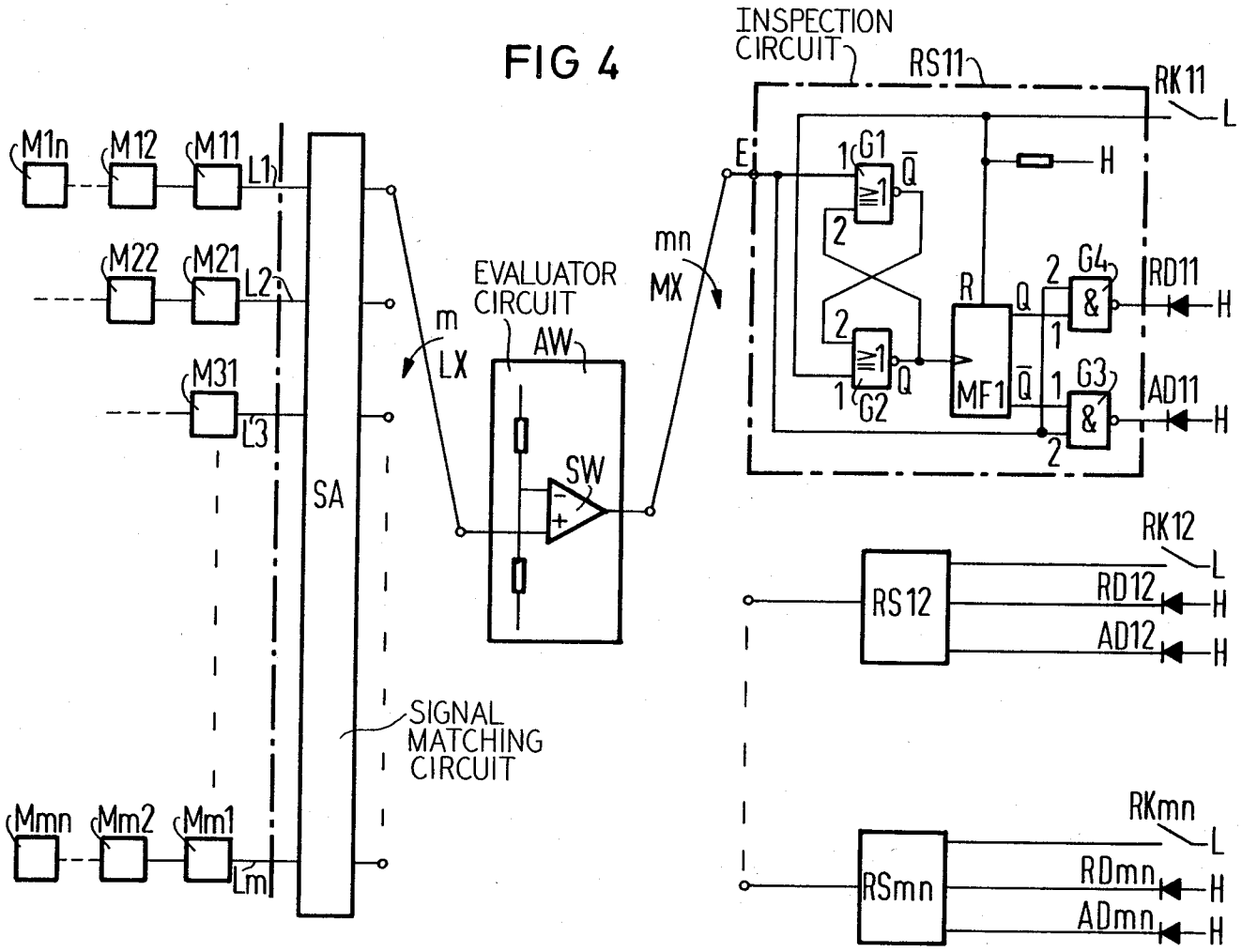

FIG. 4 is a circuit diagram showing the arrangement and circuitry of a central station for an alarm system constructed in accordance with the principles of the present invention.

Figure 5:
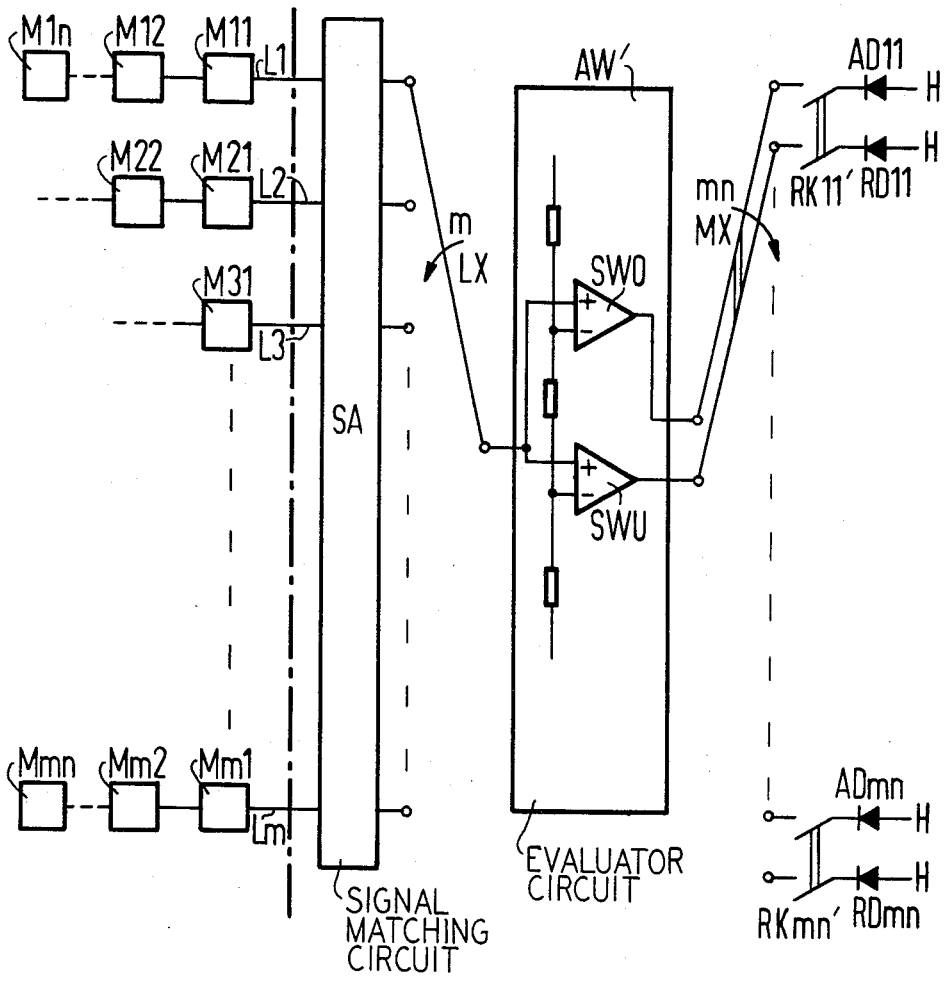

FIG. 5 is a schematic representation of an embodiment of a portion of the central station for an alarm system constructed in accordance with the principles of the present invention utilizing two threshold circuits with an increased alarm threshold.

Figure 6:
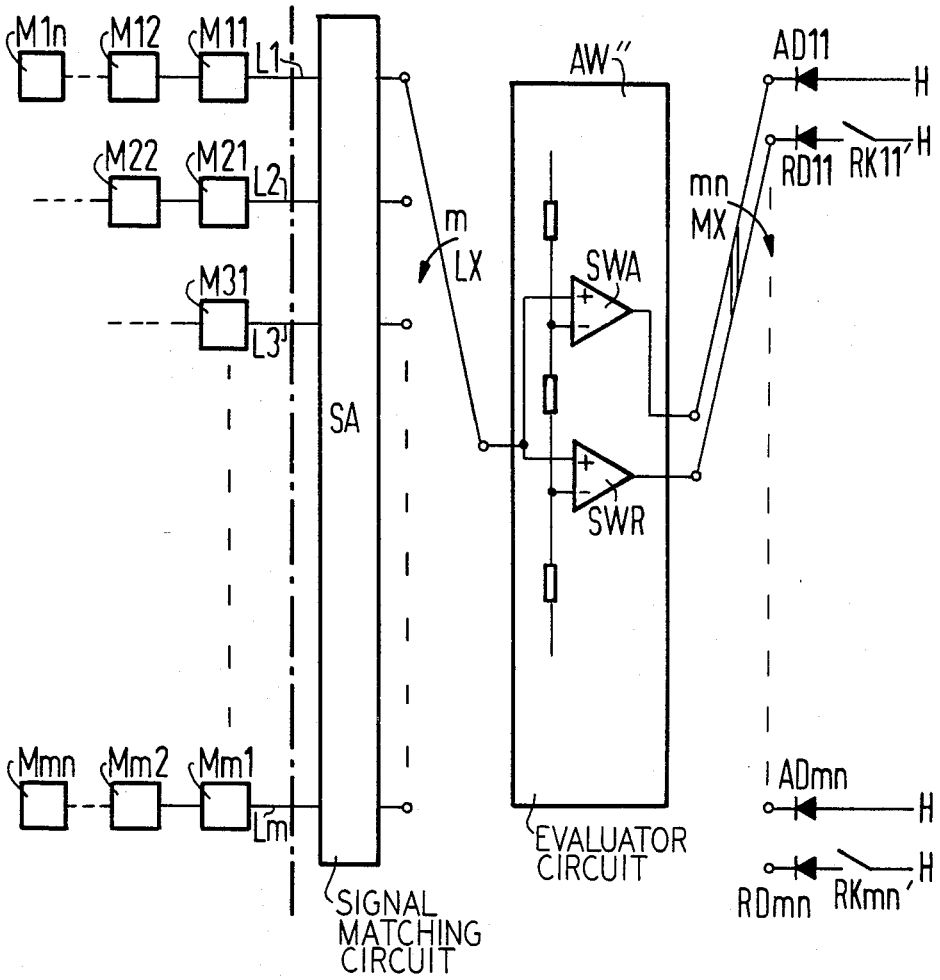

FIG. 6 is a schematic representation of a portion of a central station of an alarm system constructed in accordance with the principles of the present invention utilizing two threshold circuits with an unaltered alarm threshold.

DESCRIPTION OF THE PREFERRED EMBODIMENTS

Figure 1:
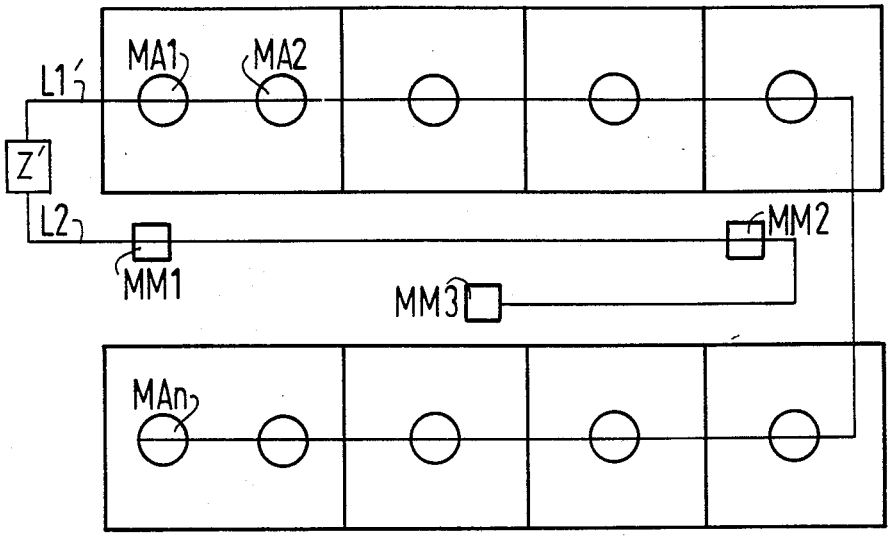
FIG 1 (PRIOR ART)
FIG. 1 is a schematic representation of the manner in which conventional alarm systems are connected to a central station.

FIG. 1 is a schematic circuit diagram of the manner of connecting a conventional danger alarm system, such as a fire alarm system, for monitoring a large area which may be comprised of several partitioned areas, such as different rooms of a building. A first report line L1' connects all of the automatic alarm units MA1 through MAn in series to a central station Z'. In such a conventional alarm system, it is necessary to provide a second alarm line L2, in addition to the first alarm line L1, for connecting a plurality of manual alarm units MM1 through MM3 in series to the central station Z' When the alarm line L1, for example, is switched to an inspection condition, one of the manual alarm units MM1 through MM3 may be manually triggered upon the sudden occurrence of a danger condition. When the manually actuatable alarm units MM1 through MM3 are switched to an inspection condition, an actually occurring danger may cause one of the automatic alarm units MAn to respond, thus causing an alarm indication.

Figure 2:
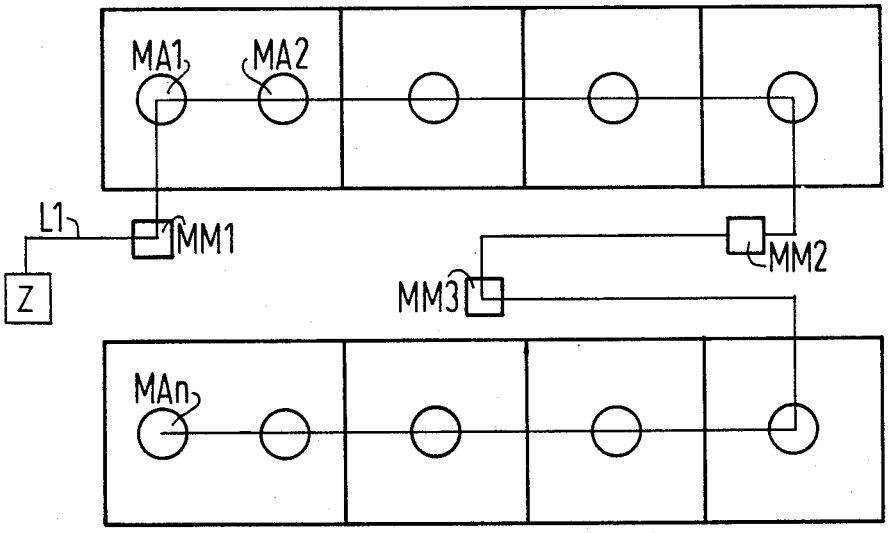
FIG. 2 is a schematic circuit diagram of the manner of connecting an alarm system to a central station in accordance with the principles of the present invention.
Figure 3A:
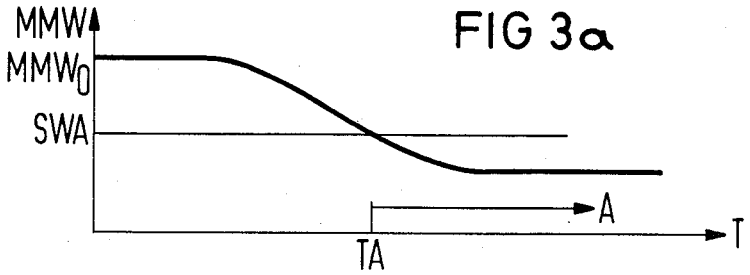
Figure 3B:
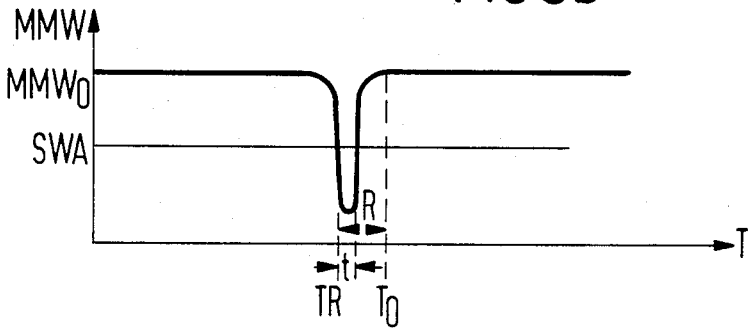
Figure 3C:
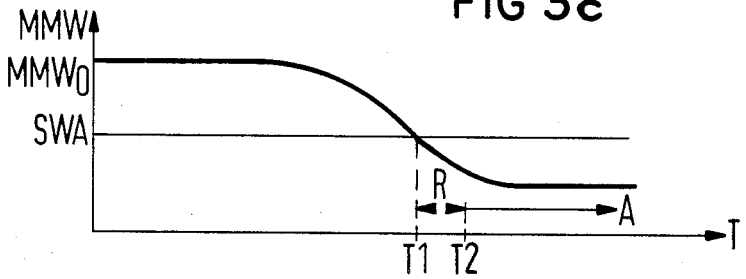
Figure 3D:
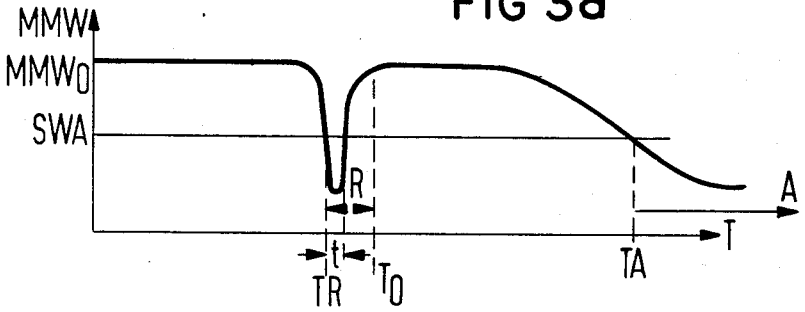

An alarm system constructed in accordance with the principles of the present invention is shown in FIG. 2 which utilizes a single alarm line L1 connecting all of the automatic alarm units MA1 through MAn and the manually actuatable alarm units MM1 through MM3 in series to a central station Z, which is shown in greater detail in FIG. 4. In the inventive system shown in FIG. 2 an inspection of the entire alarm system can be undertaken utilizing the single alarm line L1 with no danger of missing an actual alarm report. A true alarm report occurring during the inspection is evaluated and displayed as an alarm report with a slight time delay.

Voltage-time diagrams showing the manner of operation of the individual alarm units are shown under various conditions in FIGS. *3a* through *3d*. In each of those figures, time T is plotted on the horizontal axis and a measured voltage value MMW is shown on the vertical axis, with SWA representing the voltage threshold value for the individual alarm unit, and $MMW_0$ representing the quiescent voltage value for the alarm unit.

The diagram shown in FIG. *3a* represents the manner of operation of an alarm unit wherein the quiescent value $MMW_0$ of the alarm unit normally is disposed above the alarm threshold SWA and wherein a reduction of the alarm unit measured voltage MMW to or below the alarm threshold SWA at, for example, a point in time TA effects an alarm A.

When the unit operating as shown in FIG. *3a* is switched to inspection conditions, as shown in FIG. *3b*, the measured voltage value MMW emitted during the inspection by the alarm unit at a point in time TR briefly dips below the threshold value SWA for a period t. This is evaluated as an inspection signal R and is displayed as an inspection report. The alarm unit is automatically reset after a specific time such as at $T_0$.

If, as shown in FIG. *3c*, a true alarm occurs at an alarm unit which has been switched to inspection conditions then, for example, the quiescent value $MMW_0$ of the alarm unit falls below the alarm threshold SWA at a time T1 and thereby first effects an inspection report R, which is displayed as such. After a specific time such as, for example, at a point in time T2, the alarm unit is automatically reset. If the alarm unit measured voltage value MMW still lies below the alarm threshold SWA at this point in time T2, this is perceived and displayed as an alarm A. Thus an alarm report is not lost during the inspection but is only displayed with a small time delay.

The voltage-time curve of an alarm unit having an inspection report R followed by a true alarm A is shown in FIG. *3d*. The alarm unit is switched to inspection conditions and is inspected at a point in time TR, resulting in the brief drop of the alarm unit measured voltage value MMW from the quiescent value $MMW_0$ below the alarm threshold SWA. After the inspection period t, the alarm unit measured voltage value MMW returns to its quiescent value $MMW_0$ The inspection report R is displayed and this inspection report is stored in a manner more fully described in connection with FIG. 4. After a specific time, such as at a point in time $T_0$, the alarm unit is automatically reset. A true alarm occurring at a point in time TA of the alarm unit which has already been inspected thus results immediately in a true alarm signal A. The drop of the alarm unit measured voltage value MMW below the alarm threshold SWA effects the immediate indication of the alarm A.

An alarm indication can thus occur immediately upon the occurrence of a true alarm after an alarm unit has already been inspected and it is not necessary to wait until all alarm units within a specific area have been inspected in order to re-arm the individual alarm units of this area together at a single point in time.

The arrangement and details of a central station constructed in accordance with the principles of the present invention are shown in FIG. 4 wherein all components to the left of the dot and dash line represent individual alarm units, and all components to the right of the dot and dash line are located at the central station Z shown in FIG. 2. In FIG. 2 only the alarm units for one alarm line L1 of the total system were shown, in FIG. 4 a plurality of alarm lines L1 through Lm are represented, each line having a plurality of individual alarm units connected in series. Each individual alarm is referenced by M followed by a first digit indicating the number of the alarm line in which the alarm unit is connected and a second digit indicating the location of the alarm in that particular line. Thus alarm line L1 contains a plurality of alarm units M11, M12 through M1n, and the alarm line Lm contains alarm units Mm1, Mm2 and Mmn. The central station contains a plurality of identical inspection circuits which are respectively associated with the individual alarm units. Thus the inspection circuit RS11 (shown in detail) evaluates signals received from the alarm unit M11 and the identical inspection circuits RS12 through RSmn respectively evaluate signals received from the alarm units M12 through Mmn.

The signals incoming from the various alarm lines L1 through Lm are reshaped for further processing in a signal matching circuit SA which may be of any suitable type known to those skilled in the art. An evaluation circuit AW which contains a threshold circuit SW samples the individual report lines L1 through Lm in succession over a line multiplexer LX and checks to determine whether a report is pending at one of those lines. Each inspection circuit, such as RS11, is driven by the evaluation circuit AW via an alarm unit multiplexer MX of a type known to those skilled in the art. In the embodiment shown in FIG. 4, a report from an alarm unit is designated by a logical high signal H at the output of the evaluation circuit AW. The inspection circuits RS11 through RSmn are selected in sequence by the alarm unit multiplexer MX. Each inspection circuit has an inspection switch such as switches RK11 through RKmn as well as an inspection display diode, such as diodes RD11 through RDmn, and an alarm display diode, such as diodes AD11 through ADmn. The inspection display diodes and the alarm display diodes are respectively supplied with a high signal H and the inspection switches are connected to a logic low signal L.

The manner of operation of the inspection circuits will be explained in connection with the inspection circuit RS11 has a memory consisting of two cross-connected gates, such as a first NOR gate G1 and a second NOR gate G2. A monostable flip-flop or monoflop MF1 is post-connected to the memory and has a set output Q which is connected to the first input of a NAND gate G4 and a reset output $\overline{Q}$ connected to the first input of a NAND gate G3. The output of the NAND gate G4 is connected to the inspection diode RD11 and the output of the NAND gate G3 is connected to the alarm diode AD11. The alarm unit signal supplied to an inspection circuit input E via the multiplexers LX and MX and the evaluator circuit AW is conducted to a first input of the NOR gate G1 and to the second inputs of the NAND gates G3 and G4. A high signal H is normally supplied to the reset input R of the monoflop MF1 and to the first input of the NOR gate G2, however, when the inspection switch RK11 is closed, a low signal L is supplied to those inputs. The output of the NOR gate G1, which serves as the reset input $\overline{Q}$ of the memory, is connected to the second input of the NOR gate G2 and the output of the NOR gate G2, which serves as the set output Q of the memory, is connected to the second input of the NOR gate G1.

When an alarm unit such as alarm unit M11 is switched to an inspection condition, the inspection switch RK11 for the associated inspection circuit RS11 is closed. The alarm unit M11 supplies a logic high signal H to the input E of the inspection circuit RS11 so that the memory, comprised of the two NOR gates G1 and G2, is set and the monoflop MF1 is also set. During the time which the monoflop MF1 is set, the drive of the alarm diode AD11 via the NAND gate G3 is suppressed. The set time for the monoflop MF1 is selected longer than the time during which an inspection report normally requires, an inspection report resulting only in the fact that the memory is set but the alarm diode AD11 is not driven. During the time of an inspection report, that is, during the time the inspection switch RK11 is closed, an inspection report is displayed by the inspection diode RD11 via the NAND gate G4.

A true alarm will last longer than the brief inspection report period so that, after cycling of the monoflop MF1, an alarm report is displayed at the alarm diode AD11. When, after cycling of the monoflop MF1, a second report of an alarm unit such as alarm unit M11 arrives later, this is directly forwarded as an alarm report to the alarm diode AD11. When the alarm unit M11 is armed, the inspection switch RK11 is open and the memory consisting of the two NOR gates G1 and G2 is reset as is the monoflop MF1. Reports from the alarm unit M11 then proceed directly to the alarm display diode AD11 via the NAND gate G3. The same applies to the further inspection circuits RS12 through RSmn.

Another embodiment of the method and apparatus disclosed and claimed herein can be utilized in existing danger alarm systems wherein the evaluation of an analog signal from an alarm unit is undertaken at a central station, this embodiment utilizing upper and lower threshold stages to set upper and lower cut-off limits in an evaluation means. Such an embodiment is shown in FIG. 5 wherein, as in FIG. 4, components to the left of the dot and dash line represent individual alarm units and components to the right of the dot and dash line represent components at the central station Z shown in FIG. 2. The alarm lines L1 through Lm shown in FIG. 5 correspond to those already described in connection with FIG. 4 and the signal matching undertaken by the signal matching circuit SA and the line multiplexing undertaken by the line multiplexer LX proceed in the same manner as already described in connection with FIG. 4. In the embodiment shown in FIG. 5, however, the evaluator circuit AW' contains two threshold circuits SWO and SWU for respectively setting an upper and a lower threshold. The inspection circuits RS11 through RSmn shown in FIG. 4 are not necessary in the embodiment of FIG. 5 because the decision as to whether a report received from one of the alarm units is an inspection report or an alarm report is undertaken in the evaluator circuit AW'. The response threshold for a received signal is set higher in the evaluator circuit AW' during an inspection, however, the lower threshold stage SWU is still operative during the inspection for perceiving an inspection report. The outputs of the upper and lower threshold stages SWO and SWU are connectable to respective pairs consisting of an alarm display diode such as diodes AD11 through ADmn and an inspection display diode such as diodes RD11 through RDmn via a multiplexer MX and a plurality of bipolar inspection switches RK11' through RKmn'. The switches RK11' through RKmn' are closed during an inspection so that an inspection signal received from an alarm unit being inspected will be transmitted through the lower threshold stage SWU to illuminate the appropriate inspection display diode, while an alarm signal received from the same alarm unit during an inspection can still be processed by the upper threshold stage SWO, thereby illuminating the appropriate alarm display diode. During normal operation the inspection switches RK11' through RKmn' are opened as shown in FIG. 5 and the threshold of the evaluator circuit AW' is again switched to the lower threshold value SWU which, upon the occurrence of an alarm signal from an alarm unit under non-inspection conditions causes illumination of the appropriate alarm display diode by another path, not shown in FIG. 5.

In the embodiment shown in FIG. 5, the upper threshold which serves as the response threshold for an alarm signal during an inspection is unaltered. During the inspection, the alarm unit to be inspected supplies only a low current so that an alarm signal is not triggered by the upper threshold stage SWO. That is, the threshold which is normally used as the alarm threshold during non-inspection conditions is utilized as the lower threshold SWU, and during inspection conditions the alarm threshold is altered to the higher threshold SWO.

An embodiment in which the alarm threshold remains unaltered is shown in FIG. 6 wherein the evaluator circuit AW" includes an upper threshold stage SWA which is utilized as the alarm threshold stage both in normal operation and during an inspection. In this embodiment, during an inspection, a lower threshold stage SWR which responds to extremely low signal levels is utilized to evaluate an inspection signal received from one of the alarm units. During an inspection, inspection switches RK11 through RKmn are closed and the multiplexer MX cyclically connects the outputs of the upper and lower threshold stages SWA and SWR to the appropriate display diodes. All of the embodiments can be realized in a microcomputer at the central station.

Although changes and modifications may be suggested by those skilled in the art it is the intention of the inventors to embody within the patent warranted hereon all changes and modifications as reasonably and properly come within the scope of their contribution to the art.

We claim as our invention:

1. A method for inspecting a plurality of alarm units in a danger alarm system having a central station connectible to each of said alarm units and each of said alarm units emitting an alarm signal during normal operation upon the occurrence of a danger condition in an area monitored by said alarm unit and emitting an inspection signal of shorter duration than said alarm signal during an inspection signal of said system, said central station having an alarm display means and an inspection display means, comprising the steps of:

cyclically connecting said alarm units to a signal evaluation means at said central station;

evaluating and displaying at said inspection display means a first report received by said central station from an alarm unit being inspected after connection to said signal evaluation means;

automatically resetting said alarm unit being inspected after a selected time delay to normal operation after said first report has been received;

storing said inspection report to indicate said alarm unit has been inspected; and maintaining a path from an alarm unit being inspected to said alarm display means during said inspection such that an alarm signal received at said central station during said inspection is not suppressed and is evaluated by said central station, and is displayed by said alarm display means if danger conditions exist after said time delay.

2. The method of claim 1 wherein the step of evaluating and displaying a first report received by said central station as an inspection report and the step of automatically resetting said alarm unit being inspected after a selected time delay are repeated a selected number of times before the step of evaluating and displaying a next report received from the inspected alarm unit as an alarm report.

3. The method of claim 1 wherein each of said alarm units are individually cyclically connected to said signal evaluation means.

4. The method of claim 1 wherein said alarm units are selectively grouped in a plurality of groups and wherein said groups of alarm units are cyclically connected to said signal evaluation means.

5. The method of claim 1 wherein all of said alarm units in said system are cyclically connected to said signal evaluation means.

6. The method of claim 1 wherein said alarm units emit multi-level or analog signals and wherein a signal received by said central station from an alarm unit is normally compared to a first threshold level and is evaluated and displayed as an alarm report if said signal exceeds said threshold level, comprising the additional step of switching said central station to a less sensitive state having a second threshold level higher than said first threshold level, while maintaining said first threshold level as operative for evaluating and displaying said first report as an inspection report and utilizing said second threshold level for evaluating and displaying said next report as an alarm report.

7. The method of claim 1 wherein said alarm units emit multi-level or analog signals and wherein said alarm signals are a higher level than said inspection signals and wherein signals received from said alarm unit by said central station are compared to a first threshold level with a signal exceeding said first threshold level being evaluated and displayed as an alarm report comprising the additional step of switching said central station during an inspection to a state utilizing a second threshold level which is lower than said first threshold level for evaluating said first report received by said central station as an inspection report, whereby said first threshold utilized for evaluating signals received from said alarm units as an alarm report remains unaltered.

8. An apparatus for inspecting a danger alarm system having a plurality of alarm units respectively connected in series in a plurality of alarm lines, a central station, and a multiplexer means for cyclically connecting said alarm lines to said central station, said alarm units emitting an alarm signal upon the occurrence of danger conditions in an area monitored by said alarm unit, and emitting an inspection signal of shorter duration and said alarm signal during an inspection of said system, said apparatus being disposed at said central station and comprising:

an alarm display means;

an inspection display means; and an evaluator means interconnected between said multiplexer and said alarm display means and said inspection display means for directing signals received from said alarm units during an inspection to said inspection display means, said evaluator means having a path during said inspection from said alarm unit being inspected to said alarm display means such that no suppression of alarm signals received from said alarm units during said inspection occurs.

9. The apparatus of claim 8 wherein said evaluator means is a means for displaying an alarm signal received from an alarm unit during an inspection of said alarm unit at said alarm display means after a selected time delay after an inspection signal has been received from said alarm unit and displayed at said inspection display means.

10. The apparatus of claim 9 wherein said evaluator means further comprises a memory for storing said inspection signal.

11. The apparatus of claim 8 wherein said evaluator means includes a plurality of inspection circuits respectively associated with each of said alarm units, each inspection circuit having an input connectable to said multiplexer means and comprising:

a memory having a memory input connected to said inspection circuit input;

a time delay element having a set input connected to an output of said memory and a reset input;

an inspection switch which is closed during an inspection of said alarm unit associated with said inspection circuit connected to an input of said memory and to said reset input of said time delay element; and a logic switching means interconnected between said time delay element and said alarm display means and said inspection display means and having an input connected to said inspection circuit input, whereby a first signal received at said inspection circuit input during an inspection of said alarm unit associated therewith is evaluated by said inspection circuit as an inspection report and is displayed at said inspection display means and a next report received at said inspection circuit input from said alarm unit during said inspection is delayed by said time delay element and is displayed at said alarm display means as an alarm report upon opening of said inspection switch.

12. The apparatus of claim 11 wherein said memory consists of first and second cross-connected NOR gates and wherein said inspection circuit input is connected to the free input of said first NOR gate and wherein said inspection switch is connected to a free input of said second NOR gate, wherein said time delay element is a monostable flip-flop having set and reset outputs, and wherein said logic switching means consists of first and second NAND gates, said first NAND gate having a first input connected to said reset output of said flip-flop and an output connected to said alarm display means, said second NAND gate having a first input connected to said set output of said flip-flop and an output connected to said inspection display means, said first and second NAND gates each having a second input connected to said inspection circuit input.

13. The apparatus of claim 8 wherein said evaluator means comprises first and second threshold circuits connectable between said multiplexer means and said alarm display means and said inspection display means, said first and second threshold circuits respectively evaluating signals received from said alarm units as an inspection report or an alarm report.

14. The apparatus of claim 13 wherein said first threshold circuit has a first threshold level which is normally utilized for evaluating a signal received from an alarm unit as an alarm report and wherein said second threshold circuit has a second threshold level which is higher than said first threshold level and which is utilized during an inspection for evaluating a signal received from an alarm unit as an alarm report while said first threshold circuit is utilized during an inspection for evaluating a signal received from an alarm unit as an inspection report.

15. The apparatus of claim 13 wherein said first threshold circuit has a first threshold level which is normally utilized for evaluating a signal received from an alarm unit as an alarm report, and wherein said second threshold circuit has a second threshold level which is lower than said first threshold level which is utilized during an inspection for evaluating signals received from said alarm units as inspection reports.

* * * * *